United States Patent [19]

Licciardi

[11] 4,210,335

[45] Jul. 1, 1980

[54] BASEBALL GAME

[76] Inventor: Bartholomew A. Licciardi, 11 B. Whittier Dr., Everett, Mass. 02149

[21] Appl. No.: 819,719

[22] Filed: Jul. 28, 1977

[51] Int. Cl.[2] ..... A63F 3/00

[52] U.S. Cl. ..... 273/238; 273/244; 273/288

[58] Field of Search ..... 273/88, 93, 137 A, 238

[56] References Cited

U.S. PATENT DOCUMENTS

| | | | |
|---|---|---|---|
| 1,170,821 | 2/1916 | Keller | 273/244 X |
| 1,177,677 | 4/1916 | Beam | 273/93 C |
| 1,409,033 | 3/1922 | Smiley | 273/93 R |
| 1,533,487 | 4/1925 | White | 273/88 |
| 1,581,189 | 4/1926 | Fuchs | 273/93 R |
| 2,283,578 | 5/1942 | Rogers | 273/93 C |
| 2,347,506 | 4/1944 | Riehle | 273/93 R |
| 2,812,181 | 11/1957 | Richman | 273/93 C |
| 3,376,041 | 4/1968 | Anderson | 273/137 A |
| 3,854,725 | 12/1974 | Cluck | 273/137 A |
| 3,957,269 | 5/1976 | Bouchard | 273/93 R |

*Primary Examiner*—Richard C. Pinkham
*Assistant Examiner*—R. Carl Moy
*Attorney, Agent, or Firm*—Walter J. Kreske

[57] ABSTRACT

A baseball game including a gameboard having a baseball field design, four decks of cards and moveable pieces shaped as a baseball player. The decks of cards include a pitcher's deck, a batter's deck, a defense deck and a catcher's deck. The pitcher's deck comprises (a) strike cards which include an indicia designating infield or outfield and (b) ball cards. When a strike card is exposed, a batter card is exposed which may be a clean hit card, a ground ball card or a fly ball card. If a ground ball card or a fly ball card is exposed, the position on the batter card must match that of the strike card otherwise a strike is called. If the positions on the batter card and the pitcher card match, a defense card or catcher's card is exposed and the outcome of the hit ball is determined by the instructions on the defense card.

7 Claims, 9 Drawing Figures

Fig. 1.
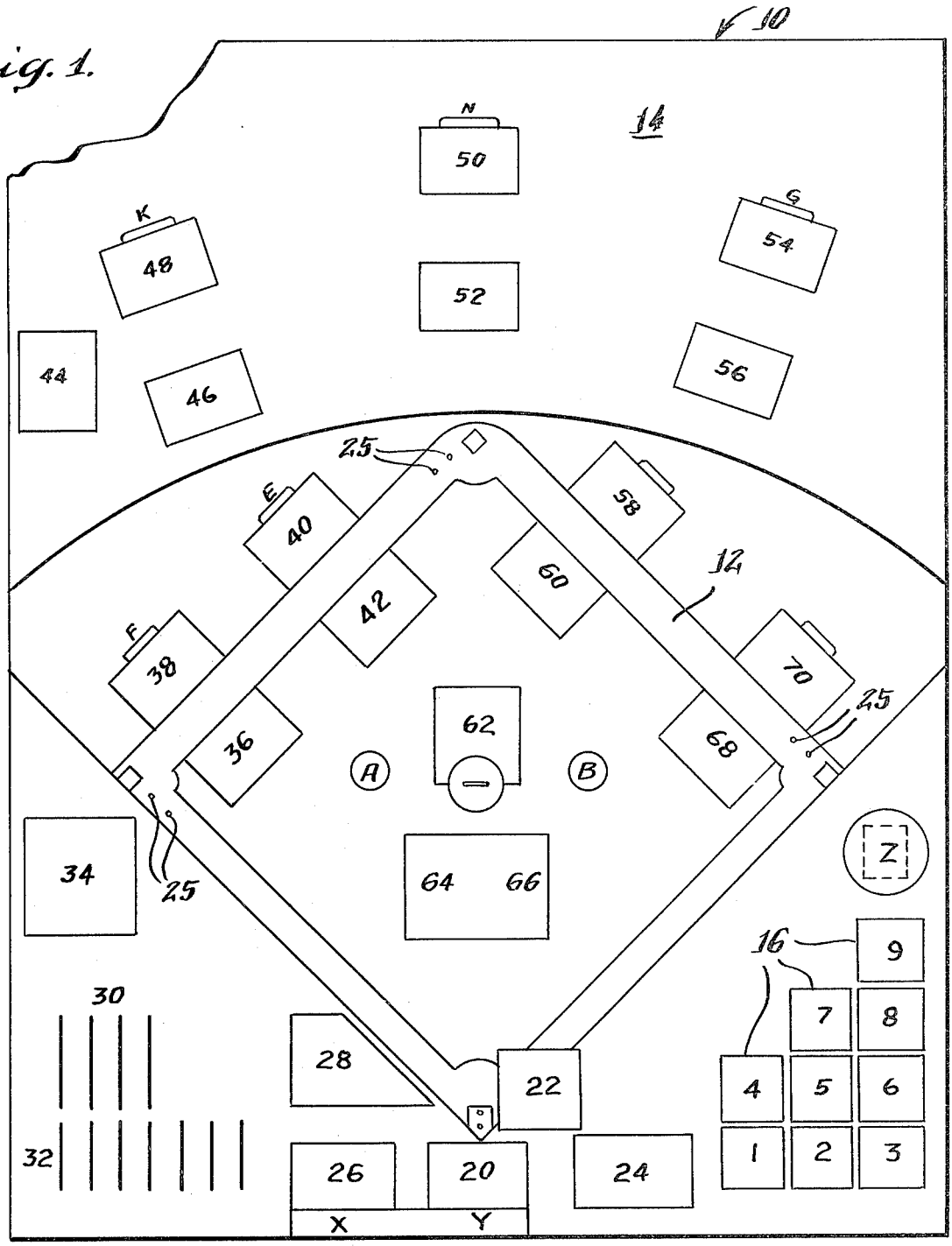
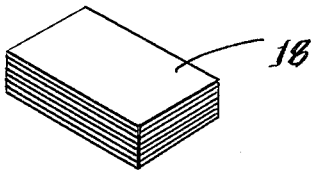
Fig. 2
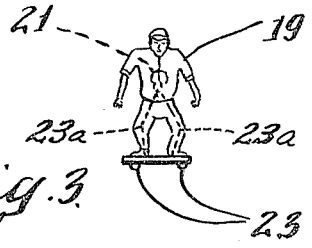
Fig. 3

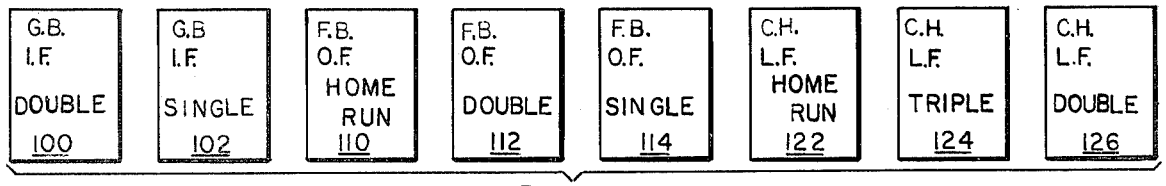
Fig. 4. BATTER'S CARDS
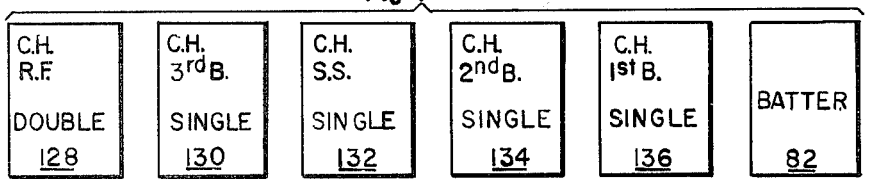
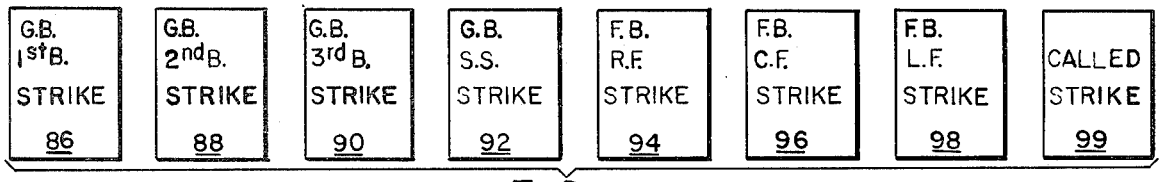
Fig. 5. PITCHER'S CARDS
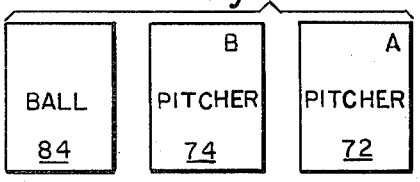
Fig. 6 INFIELD DEFENSE CARDS
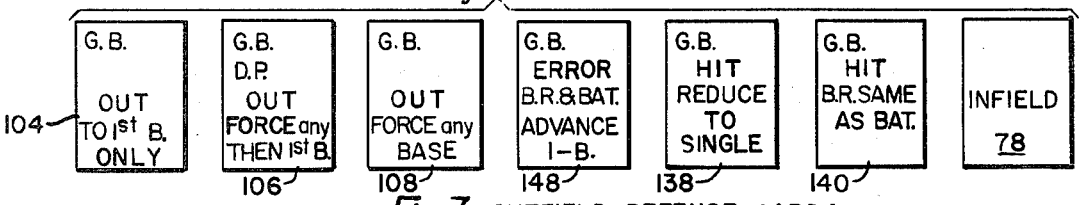
Fig. 7. OUTFIELD DEFENSE CARDS
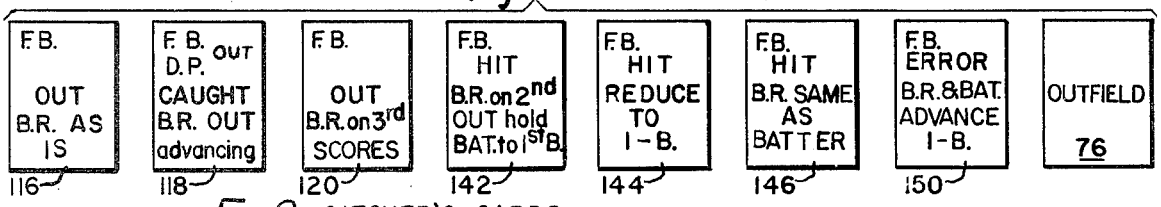
Fig. 8. CATCHER'S CARDS
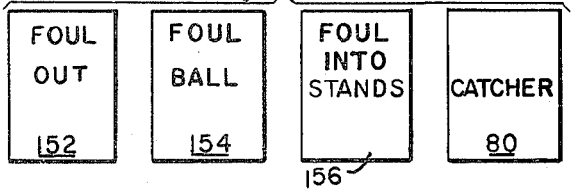
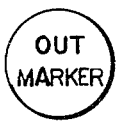
Fig. 9.

BASEBALL GAME

PRIOR ART

The following U.S. patents are considered pertinent: U.S. Pat. Nos. 1,709,634, 2,283,578, 2,788,213, 2,812,181, 2,911,220, 2,933,316, 3,528,661 and 3,957,269.

BACKGROUND OF THE INVENTION

This invention relates to a simulated baseball game.

There are available presently a wide variety of simulated baseball games. It is an object of this invention to provide a baseball game which more accurately simulates an actual baseball game than presently available baseball games. It is a further object of this invention to provide a baseball game which provides substantially all of the game situations encountered in an actual baseball game.

SUMMARY OF THE INVENTION

In playing the game of this invention, an imaginary pitcher on the mound is provided in the form of a deck of cards comprising strike and ball cards on the playing board. The imaginary pitcher throws an imaginary ball or strike by turning face up one at a time, the cards from the pitcher's deck. The imaginary batter in the batter's box on the playing field board attempts to hit the pitched ball by turning a batter card face up in the batter's box. When the position on the batter card matches the position on the pitcher card, the batter will have imaginarily batted the ball toward the defense position directed by the pitcher cards. The top card dealt at the defense position indicated on the pitcher's card then is turned face up. The outcome of the imaginary play shall depend upon the dictates of the defense card. When the position on the batter's card and on the pitcher's card do not match, a strike is called on the batter. The batter is out when three strikes are called on him.

The pitcher's deck consists of strike and ball cards, for example 15 strike cards and 9 ball cards. Each strike card dictates the defensive position at which the play on a hit ball is to take place.

The batter's deck consists of "clean hit" cards, "ground ball" cards and "fly ball" cards, for example, 8 cards each for each category. When a clean hit card is exposed, the batter obtains an automatic hit. When the ground ball or fly ball cards are exposed, the batter is out, has a hit or has a strike assessed against him based upon the rules set forth above. In addition, if the batter has less than two strikes assessed against him, he has a choice to put the ball in play or have a strike assessed against him.

The defense deck includes cards for each outfield and infield position and the cards are placed at each position on the board as indicated on the card. For example, a defense deck can consist of fifteen cards; seven outfield cards and eight infield cards. The catcher's deck comprises foul cards or out cards. For example nine foul cards and three out cards for foul balls, seven out attempting to steal and five successively stolen base cards combined into 12 cards.

BRIEF DESCRIPTION OF THE DRAWINGS

FIG. 1 is a top view of the playing board of this invention.

FIG. 2 is a plan view of a playing card of this invention.

FIG. 3 is a perspective view of a player piece used in this invention.

FIG. 4 is a plan view of representative cards in a batter's deck of this invention.

FIG. 5 is a plan view of representative cards in a pitcher's deck of this invention.

FIG. 6 is a plan view of representative infield cards of a defense deck of this invention.

FIG. 7 is a plan view of representative outfield cards of a defense deck of this invention.

FIG. 8 is a plan view of representative cards in a catcher's deck of this invention.

FIG. 9 is a plan view of an out marker of this invention.

DETAILED DESCRIPTION OF THE PREFERRED EMBODIMENTS

The game board 10 includes an infield diamond 12 and an outfield area 14. The game board 10 also includes nine numbered batters squares 16, an area 20 for placing the catcher's deck face down, a batter's box 22 and an area 24 for placing a batter's chart to record strikes and balls. Exposed catcher cards are placed in area 26. A pitcher's chart is placed in area 28. An infield chart is placed in area 34. Third base cards are placed face down in area 38 and exposed face up in area 36. Short stop cards are placed face down in area 40 and exposed face up in area 42. An outfield chart is placed in area 44. Left field cards are placed face down in area 48 and exposed face up in area 46. Center field cards are placed face down in area 50 and exposed in area 52. Right field cards are placed face down in area 54 and exposed in area 56. Second base cards are placed face down in area 58 and exposed in area 60. Pitcher cards are placed face down in area 62 and exposed in area 64. Batter's cards are exposed in area 22. First base cards are placed face down in area 70 and exposed in area 68.

In summary, the positions on the game board are as follows:

16—Batter's line up dealt face down (1) in each
20—Place catcher deck here face down
22—Batter's box
24—Batter's chart here
26—Turn Up catcher's card here
28—Pitcher's chart here
30—Wedge cards scored
32—Slits for cards scored in these slits
34—Infield chart here
36—Turn up 3rd base here
38—Deal 2 infield cards here
40—Deal 2 infield cards here
42—Turn up shortstop card here
44—Outfield chart here
46—Turn up left field card here
48—Deal (2) outfield cards here
50—Deal (3) outfield cards here
52—Turn up centerfield card here
54—Deal (2) outfield cards here
56—Turn up rightfield cards here
58—Deal (2) infield cards here
60—Turn up 2nd base card here
62—Place pitcher's deck here face down
64—Play pitcher
66—Cards here
68—Turn up first base card here
70—Deal (2) infield cards here The decks of cards 18 are shown collectively in FIG. 2 and representative ones of which are shown in respective decks in FIGS. 4 through 8 as will be hereinafter further described. As shown in FIG. 3, the moveable player pieces 19 include an electric light bulb 21 electrically coupled by electric wires 23a to electric terminal prongs 23 which fit into electrical slots 25 which comprise any suitable electrical arrangement for causing the light bulb 21 to be lit upon receiving the electric terminal prongs 23 on the playing board 10. Each player piece 19 is shaped as a baseball player to help the present invention in its simulation of an actual baseball game by placement as base runners at the respective bases resulting from baseball plays as will be hereinafter further described. There are two pitcher's decks, A, black and B, red which identification may appear on a face of each of the cards of the respective pitcher's decks as appear on cards 72 and 74 respectively in FIG. 5. The black deck is the first to bat and whoever chooses the red deck is the home team and bats last. Team A first to bat shuffles defense (infield-outfield) deck which identification may appear on a face of each of the respective infield and outfield cards as appears on cards 78 and 76 respectively in FIGS. 6 and 7 respectively, and deals out one at a time to their respective positions face down from left to right making sure to put the O.F. (OUT-FIELD) on the L.F. (LEFT FIELD)-C.F. (CENTER FIELD) and R.F. (RIGHT FIELD) positions and the I.F. (INFIELD) on the 3rd B. (BASE) S.S. (SHORT STOP)-2nd B. (SECOND BASE) and 1st B. (FIRST BASE).

Team A takes catcher's deck, which identification may appear on a face of each of the respective catcher'-cards as appears on card 80 in FIG. 8, shuffles them and places them face down on the catcher's box behind the home plate. Team B next shuffles batter's deck, which identification may appear on a face of each of the respective batter's cards as appears on card 82 in FIG. 4, and deals one at a time face down on batters boxes or squares numbered 1 through 9 at 16 on playfield board 10. After filling all nine squares the remaining cards are placed on the deck square (Z). Batters cards are replaced in squares as needed as the nine batters have expired. Team B shuffles his own pitcher's deck of cards and places them face down on pitcher's box position 62. This is repeated after disposing of each batter until three outs are obtained for each half inning. After three outs, the teams change positions.

The first 3 outs (team A) at bat shuffles and deals out the defense deck—(INFIELD OUTIFIELD) & (CATCHERS) deck. Team B pitching, shuffles and deals the batter's deck, putting 9 batters cards in the line-up squares 16 face down. After the first three outs, positions are reversed and this method of play is repeated after every three outs or half inning.

Team (B) pitching first to team (A) at bat for first time by turning the top card, one at a time, face up in the space 64 for pitchers cards; waiting after each card for batter to either declare a play or take the pitch for a strike.

When a BALL card such as 84 in FIG. 5 is turned up by the pitcher, the batter accepts it. Only when pitcher turns up a STRIKE card, such as any of cards 86, 88, 90, 92, 94, 96, 98 or 99, may he put a batter card into play if possible or when the batter's field position matches pitcher's field position on the cards. In this manner the pitcher (B) turns a pitcher card face up in area 64 from pitcher's box 62 one at a time until batter should be disposed of.

There are 8 ways of disposing the batter: (a) groundout, (b) flyout, (c) strike out, (d) foul out, (e) walk, (f) hit, (g) error and (h) base stealing.

To obtain a groundout (a) the batters card must read "G.B." groundball, I.F. infield (as for example appears on batter's cards 100 and 102 in FIG. 4) and pitcher's card must read STRIKE with one of the following position on it: 1st B. (FIRST BASE), 2nd B. (SECOND BASE), 3rd B. (THIRD BASE) or S.S. (SHORT STOP), as for example appears on pitcher cards 86, 88, 90 and 92 in FIG. 5, dictating where the defense shall turn up an infield card. The card turned up in the infield position dictates the finality of the play. For example, when a batter's card reads G.B. (GROUND BALL) and I.F. (INFIELD), such as batter's card 102, and pitcher's card reads STRIKE, S.S. (SHORT STOP) such as pitcher's card 92, then a card on short stop position 40 on the board is turned over onto area 42 by the defending team. The card reader dictates the play if defense card reads O. (OUT), such as on infield card 104, 106, or 108 in FIG. 6, then it is a groundout. A flyout (b) is determined in the same manner except that the batter's card shall read F.B. (FLY BALL) O.F. (OUT FIELD), such for example as on batter's card 110, 112, or 114 in FIG. 4, and pitcher's card must read either STRIKE-L.F. (LEFT FIELD) C.F. (CENTER FIELD) or R.F. (RIGHT FIELD), such as on pitcher's card 94, 96 or 98 respectively in FIG. 5. Again, the outfield defense card dictates the play. If defense card reads O. (OUT), such as on outfield defense card 116, 118, or 120 in FIG. 7, then it is a flyout. Similarly, a strikeout (c) occurs when the batter's card reads C.H. (CLEAN HIT) with any one of the infield or outfield positions, such for example as on batter's card 122, 124, 126, 128, 130, 132, 134 or 136 in FIG. 4, and the batter's card does not match the exact position on the pitcher's card when three pitcher's cards are turned up reading STRIKE provided there have not been four BALL cards, such as pitcher's card 84 in FIG. 5, before the third STRIKE card.

A walk (e) occurs when four BALL cards, such as any of the pitcher's cards 86 through 99, by the pitcher have been turned up before the third STRIKE card is turned up. Then the batter shall take first base and become a base runner (B.R.) where he may be represented by a player piece 19 plugged into electrical base slots 25 at first base.

A hit (f) can occur in either one of two ways: First, when the defense card, whether Infield or Outfield dictates a hit of Ground Ball or Fly Ball plays such for example as infield defense card 138 or 140 in FIG. 6, or outfield defense card 142, 144 or 146 in FIG. 7. Second, when the batter's Clean Hit (C.H.) card matches the position on pitcher's STRIKE card such for example as the batter's clean hit card 134 in FIG. 4 showing a second base (2nd B.) position and the pitcher's strike card 88 which also shows a second base (2nd B.) position. In this case a hit is obtained without turning a defense card and the batter becomes a base runner (B.R.) who may be represented by a player piece 19 plugged into the electrical slots 25 at second base.

An error (g) occurs when Ground Ball or Fly Ball cards are in play and a defense card turned up reads, "E" (Error) such for example as the infield ground ball (G.B.) defense card 148 in FIG. 6 or outfield fly ball (F.B.) defense card 150 in FIG. 7.

A foul (d) out occurs when a batters card reads G.B. (Ground Ball), I.F. (Infield) positions (such as card 100 or 102 in FIG. 4) and the STRIKE card reads F.B. (Fly Ball) O.F. (Outfield) position (such as card 94, 96, or 98 in FIG. 5) on the third STRIKE card only. In these cases, a catchers card, such as card 152, 154 or 156 in FIG. 8, is exposed to determine whether the play is just a Foul Ball or Fouled Out. In the event that it is not an Out and it is just a Foul Ball then the count on the batter remains the same and the pitcher turns up another card. If the card is a Ball it is an automatic foul, but if it is a STRIKE O.F. (Outfield) is exposed. This is repeated again on another catchers card as often as necessary until either the Batter-Fouls Outs or a batter's card matches a pitcher's card position such as Infield 1st B.-2nd B.-3rd B. or S.S., so that defense card is brought into play to dictate finality. The same applies to Fly Ball batters card when no Outfield position appears on the 3rd STRIKE pitcher's card.

Basically the rules of the game of this invention are the same as those applied to major league baseball games. When, there are base runners on 2nd and/or 3rd base and the play is being made by either Short Stop or 3rd base defense card the base runners may not leave their base unless they are forced to, because there is a base runner on 1st base also. The same rule applies when a D.P. (Double Play) card, such as double play card 106 in FIG. 6 and double play card 118 in FIG. 7, is turned up at any defense position. When, there are base runners on 2nd and/or 3rd base either or both may move up a base when the play is being made, either by 1st base or 2nd base defense cards. When, the defense card is turned up either by O.F. (Outfield) or I.F. (Infield) positions the defense card shall dictate the play at all times and be final. There shall be no runs allowed while the third and final out is being made, nor any base runners advancement. When, a C.H. (Clean Hit) batter card, such as any one of cards 122 through 136 in FIG. 4, matches a pitchers STRIKE card position, such as from among cards 86 through 98 in FIG. 5, it then becomes an automatic base hit and batter takes as many bases as the batter card reads. However, the base runner may take one more than the batter. A Clean Hit is obtained only when fielding position below C.H. on the batter's card matches the same position on the STRIKE card. When, a G.B. (Ground Ball) probable hit card is in play and the batter does reach base then all base runners take the same amount of bases as the batter. When, a F.B. (Fly Ball) probable hit card is in play and the batter reaches base, all base runners take same amount of bases as batter.

When, all defense cards at any position have been turned up before the third out then the position shall be declared Open and all plays directed at those positions shall become automatic G.B. or F.B. hits. The base runners shall be allowed to move ahead the same amount of bases as the batter. When, the batter has been put out, the defense puts an out marker, for example such as in FIG. 9, on the card declared out. If the defense fails to put the out marker on the batter card before the first pitch or before the batter's card is exposed to the next succeeding batter, the out is forfeited and the batting team is granted an extra out. When, either team is behind by three runs or more at end of seven innings pinch hitters may be used. However, no more than three pinch hitters are used in any one inning and no more than six pinch hitters in an entire game. When a pinch hitter is used and the game is tied or the player goes ahead, pinch hitters no longer are used. To put a pinch hitter into play the batter has the right to demand a second card be dealt to him from the batter's card in (On Deck) circle at any time before 3 strikes 4 balls are assessed to give the batter two batter's cards. The batter must choose which one of the two cards he wishes to use and discard the other, so that he will only have one batter's card when the pitchers resume to finish disposal of batter.

An inning consists of two three out periods one for each team. A regulation game consists of five or more innings as decided by the players before the game is started.

It is to be understood that this invention is not limited to the embodiments specifically described but includes modifications which will be evident to the person skilled in the art.

What is claimed is:

1. A baseball game comprising:

(a) a game board having a baseball field design thereon and specifically marked areas at positions corresponding to the infield and outfield defensive positions of first base, second base, shortstop, third base, left field, center field and right field of an actual baseball field for placing defensive playing cards face down and another specifically marked area at each of the said positions for placing defensive playing cards face-up;

(b) three decks of cards, each deck containing a number of cards, including a pitcher's deck with each of a plurality of the pitcher's deck cards having a different indicia thereon and includes a separate strike card for each of said infield and outfield defensive gameboard positions and the indicia on each of said plurality of pitcher's deck cards corresponds to the associated one of said gameboard positions, a batter's deck with each of the batter's deck cards having different indicia thereon, the indicia on each of said batter's deck cards corresponds to the indicia on one of said plurality of pitcher's deck cards and includes a separate batter's deck card for each of said infield and outfield defensive gameboard positions and the indicia on each of said batter's deck cards corresponds to the associated one of said gameboard positions for thereby providing a structure making possible simulated pitching to a batter by matching of position indicia on successive pitcher deck cards against position indicia on a batter's deck card for determining strikes and hits by the batter, and a defense deck of cards, the cards in each deck including baseball plays thereon, and (c) moveable pieces representing base runner baseball players adapted to be placed at each base on said playing field in accordance with the outcome of said baseball plays.

2. The game of claim 1 wherein each of said moveable pieces has the shape of a baseball player and includes an electric light bulb adapted to be lit when the associated moveable piece is placed at a base on said playing field.

3. The game of claim 1 wherein said board includes a specifically marked area for placing each of nine batters' cards face down to determine successive turns at bat, a tenth specifically marked area for placing the remaining batters' cards face down, and a specifically marked area for placing face-up a batter's card from said nine for a turn at bat.

4. The game of claim 3 wherein said moveable pieces each has an electric light bulb adapted to be lit when the associated moveable piece is placed at a base on said playing field.

5. The game of claim 3 wherein said board includes a specifically marked area for placing said pitcher's deck of cards face down at the commencement of said game, and another specifically marked area for placing cards from said pitcher's deck face down area face-up as needed during the playing of said game.

6. The game of claim 5 wherein said board includes a specifically marked area for placing said catcher's deck of cards face down and another specifically marked area for placing cards from said catcher's deck face down marked area face-up as needed during the playing of said game.

7. The game of claim 6 wherein said board includes a plurality of slots for receiving batter's cards which have scored during a half inning of play.

* * * * *